United States Patent [19]

Kaczerwaski

[11] Patent Number: 4,611,350

[45] Date of Patent: Sep. 9, 1986

[54] BAG HAVING A BAND OF REDUCED DIAMETER

[75] Inventor: David J. Kaczerwaski, Manchester, N.Y.

[73] Assignee: Mobil Oil Corporation, New York, N.Y.

[21] Appl. No.: 661,746

[22] Filed: Oct. 17, 1984

[51] Int. Cl.[4] ..... B65D 33/00

[52] U.S. Cl. ..... 383/7; 206/802; 215/11 E; 220/404; 383/71

[58] Field of Search ..... 220/404; 383/24; 215/11 E; 383/71, 7; 206/802

[56] References Cited

U.S. PATENT DOCUMENTS

| | | | |
|---|---|---|---|
| 2,654,892 | 10/1953 | Szabo | 141/390 |
| 2,819,834 | 1/1958 | Brady | 383/120 |
| 2,826,324 | 3/1958 | Hoag | 215/11 E |
| 2,915,098 | 12/1959 | McKay, Jr. et al. | 383/120 |
| 3,589,422 | 6/1971 | Bellamy et al. | 383/24 |
| 3,758,024 | 9/1973 | Bethke et al. | 383/170 |
| 4,263,934 | 4/1981 | Redden et al. | 220/404 |
| 4,509,570 | 4/1985 | Eby et al. | 141/390 |

*Primary Examiner*—Stephen P. Garbe

*Attorney, Agent, or Firm*—Alexander J. McKillop; Michael G. Gilman; James P. O'Sullivan

[57] ABSTRACT

A sack of a thermoplastic film comprising an open mouth region, a body region and a closed bottom region, said body region having at least one cold-stretched, circumferential band of reduced diameter therein. The method of forming such a sack comprising providing a sack of thermoplastic film; folding said bag at least once longitudinally so that the fold line is at least generally at right angles to the bag mouth opening; and at ambient temperature, applying a stretching force within at least one comparatively narrow band region across the folded bag, said stretching force being sufficient to neck-down the plastic film to a reduced diameter in relation to the original diameter of said bag.

7 Claims, 6 Drawing Figures

BAG HAVING A BAND OF REDUCED DIAMETER

BACKGROUND OF THE INVENTION

This invention relates to a thermoplastic film bag having at least one band of reduced diameter adjacent to the bag mouth opening.

The bags contemplated by the present invention are of the type known as liners for various containers such as waste baskets, garbage cans and the like. An annoying and time consuming problems associated with such liners is the fact that during use items thrown into a lined container tend to force the liner down inside of the container with the result that subsequent material thrown into the container land outside of the liner.

Various solutions to the problem have been attempted with varying degrees of success. For example, U.S. Pat. No. 4,037,778 discloses a bag support, consisting of a collapsible cardboard insert for a plastic bag, employed so that the bag may be held open for the insertion of whatever material is to be placed therein. U.S. Pat. No. 4,338,979 relates to a bag holding device comprising an elastic band which encircles the outside of a box-like structure. These devices are impractical and depend upon the utilization of a special container or form in coping with the problem.

It is an object of the present invention to modify the stucture of any thermoplastic bag designed as a container liner so that the result is an increased resistance to the liner being forced within the container.

SUMMARY OF THE INVENTION

The present invention is directed to a sack or bag of a thermoplastic film comprising an open mouth region, a body region and a closed bottom, said body region having at least one cold-stretched, circumferential band region of reduced diameter adjacent to the bag mouth opening.

The invention also is directed to a method of preparing a sack of a thermoplastic film material wherein said sack has at least one circumferential band of reduced diameter adjacent to the mouth region of the sack, said method comprising:

(a) providing a sack of thermoplastic film comprising an open mouth region, a body region and a closed bottom region;

(b) folding said bag at least once longitudinally so that the fold line is at least generally at right angles to said bag mouth opening and the bottom of the bag; and (c) at ambient temperature, applying a stretching force within at least one comparatively narrow band region across the folded bag, said stretching force being sufficient to neck-down the plastic film to a reduced dimension without breaking said film so that on opening said bag at least one band of reduced diameter is formed in the body region of said bag.

DETAILED DESCRIPTION OF THE INVENTION

Figure 2:
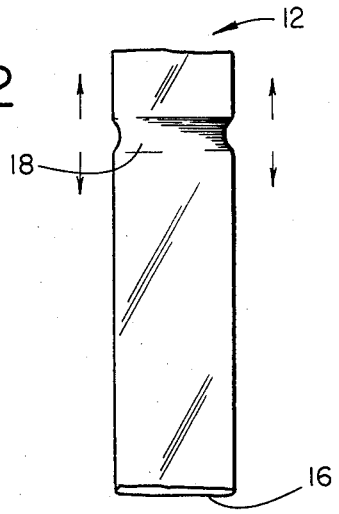
FIG. 2 is a plan view of the sack of FIG. 1 shown folded longitudinally a plurality of times along a line at right angles to the bag mouth opening.

Referring in detail to the drawings, wherein similar parts of the invention are identified by like numerals, there is seen thermoplastic sack 10 having a bag mouth opening 12, a bag body 14 and a sealed bottom 16. Adjacent to the top or the opening of the bag is a region of reduced diameter 18, circumferentially formed in the body of the bag. FIG. 2 illustrates the manner of safely and effectively forming the circumferential band of reduced diameter in a thermoplastic film in the region adjacent to the bag mouth opening 12. Since thermoplastic bag liners are normally made of extremely thin gauge plastic, for example, in dimensions ranging anywhere from about 0.1 to 2 mils or greater, it would be difficult but not impossible to practice the present invention by forming the circumferential band of reduced diameter by acting on a single layer of film. It has been found, however, to be more practical, more efficient, and quicker to effect the reduction in dimension by acting on a plurality of thicknesses of the bag film at one time. This is accomplished by taking a liner bag otherwise already completed and folding it at least once, but preferably a plurality of times, so that the fold lines are at right angles to the bag mouth opening and the bottom of the bag. The bag then is in a layflat condition having a plurality of superimposed layers of film. By uniformly applying diametrically opposed forces or, a single force against a fixed grip, in a narrow region such as that illustrated at 18 in FIG. 2, without heating the film, a band of reduced diameter in the circumference of the bag will result. This is accomplished because of a phenomenon known as necking-down when opposing forces are applied to a stretchable material. It can be seen in a common rubberband or in a metal bar or in a strip of plastic. In the case of the rubberband, when the opposing forces are released, the elastic nature of the material will permit return of the band to its original dimensions. However, in the case of malleable metal or stretchable plastic, when a stretching force is applied between two points sufficient to cause the metal or plastic to yield to the force, the dimensions of the metal or film will be reduced in thickness and width. On release of the forces, obviously, the new dimensions will remain.

In accordance with the present invention, when a longitudinally folded plastic bag or container has stretching forces subjected to it, between two spaced lines, the film will neck down and the bag container will have a circumferential band of reduced diameter imposed therein as a result. The band width can be narrow or broad, for example, a band ranging from about 0.25 to about 2 inches. The bags can have one or a plurality of spaced bands of reduced diameter. The circumferential bands of reduced diameter can be formed in an otherwise completed bag or they can be formed in a thermoplastic film in tubular form and then, subsequently, manufactured into bags.

The degree of reduction in diameter will depend upon the character of the film, the gauge of the film, the degree of stretching and the distance between the fixed lines during application of a stretching force. For example, in a 24 inch diameter waste-basket liner made from polyethylene film of 0.4 mils, stretched between fixed lines about 2 inches apart, the band of reduced diameter will measure from about 2.5 to 4 inches less than the liner diameter.

Figure 1:
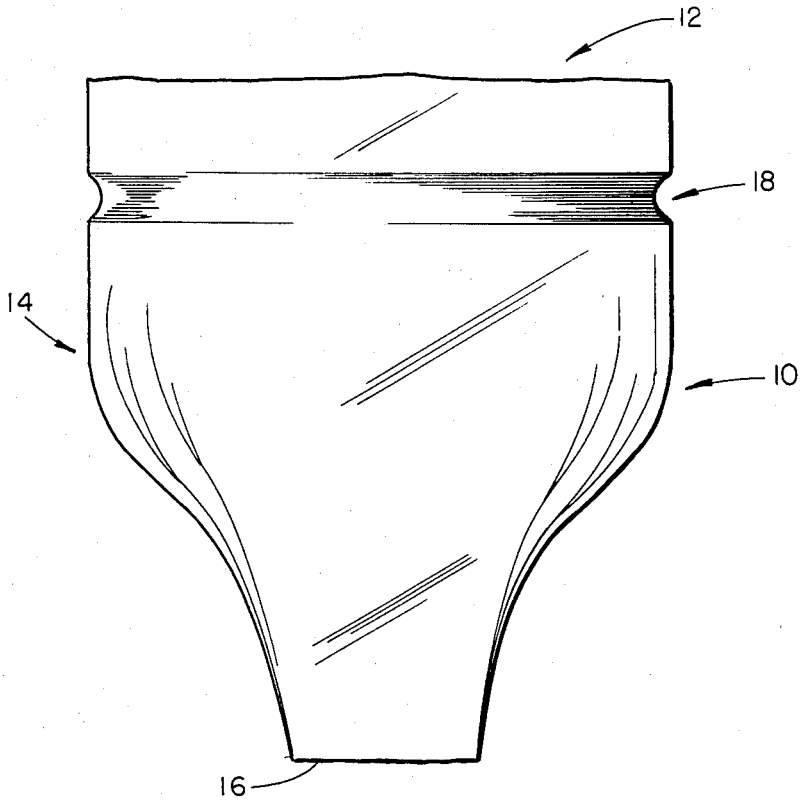
FIG. 1 is a plan view of a thermoplastic sack of the present invention.

Referring to FIG. 2, there is shown the bag of FIG. 1 longitudinally folded approximately four times and then placed in a lay flat condition. Thereafter, stretching force is applied in region 18 in opposing directions or in a single direction while the film is at ambient or room temperature condition. By "ambient temperature" is meant that the bag or film is not heated during the time of stretching. At the necking down point, the resistance of the film will be overcome and the cold film will yield to result in the region of reduced dimension and reduced diameter.

Alternatively, prior to the formation of a bag, a collapsed thermoplastic tube can be folded a number of times as in FIG. 2 and one or several regions of reduced diameter imposed into the folded tube in the same manner as in the bag of FIG. 2. Thereafter, the bottom of the bag can be formed by heat sealing and severing through the multiple folds and the bag mouth formed by a transverse cut across the tube. When such a bag is unfolded at the top region 12, a bag such as is shown in FIG. 1 will result. It will be noted that the bottom of the bag 16 remains heat sealed-gathered in the number of folds put into the tube prior to the necking down step. This will yield a bag bottom which when expanded tends to have a hemispherical shape.

Figure 3:
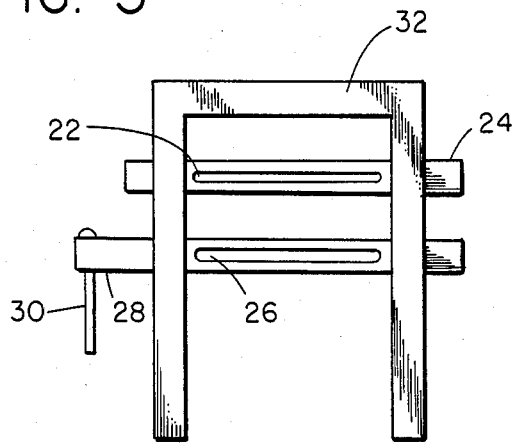
FIG. 3 is a side view of an apparatus for forming a band of reduced diameter in the wall of a thermoplastic sack.

Pictured in FIG. 3 is a simple device which can be employed to impart the force necessary to stretch or neck down the multiple folds of the bag or a bag precursor tube. For example, the bag of FIG. 2 in its folded but unstretched condition is inserted into the slot 22 of member 24. This slot is adapted to tightly hold the multiple layers of film of the bag of FIG. 2 therein. The other end of the bag, that is, the bottom end 16 is passed through slot 26 of member 28. The bag is pulled completely through slot 26 until there is tension between the layers of film between member 24 and 26. Thereafter, by rotating arm 30 increasing tension can be placed on the layers of film until the yield point is reached and exceeded to form the necking down illustrated at 18 in FIGS. 1 and 2. Members 24 and 26 can be mounted in any suitable frame member 32. Other equivalent alternative techniques can be employed to stretch the multiple layer of films to its yield point to cause the necking-down to occur.

Figure 4:
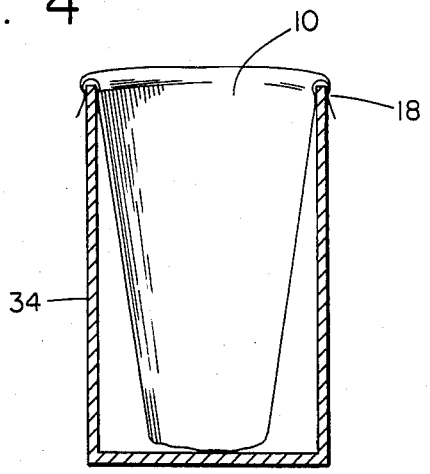
FIG. 4 is a side-view in section of a waste basket lined with a liner bag having a band of reduced diameter.

FIG. 4 shows a waste material container 34 lined by a bag 10 such as that shown in FIG. 1. The region of reduced diameter 18 is shown contacting the top external sides of the container. By this means or, alternatively, by draping the reduced circumferential band about the rim perimeter of the container the liner has a reduced tendency to be pulled or fall within the inside region of container 34.

Figure 5:
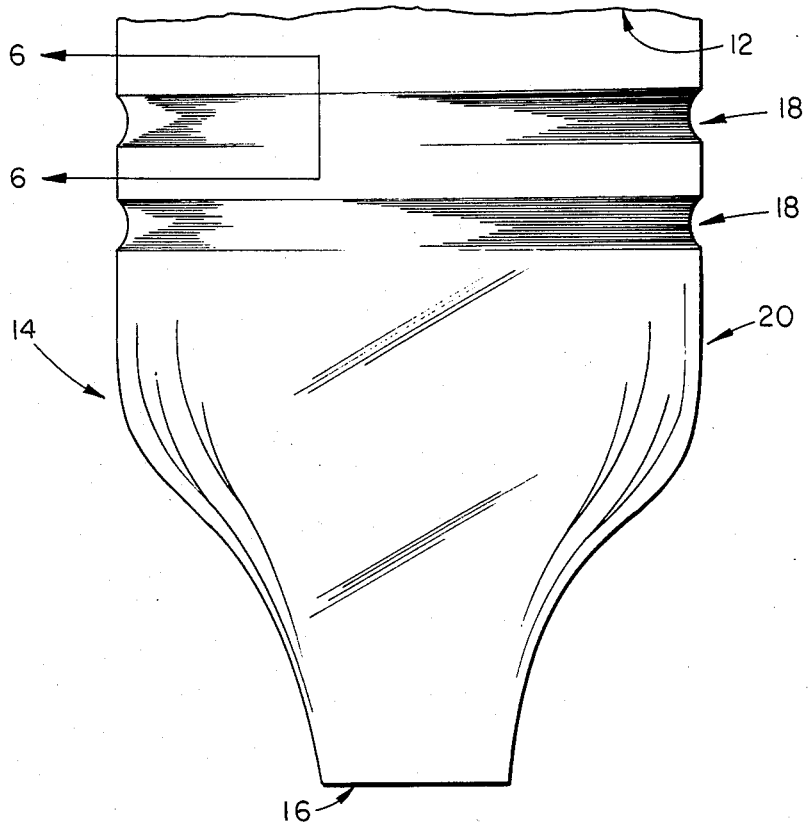
FIG. 5 is a plan view of a thermoplastic sack showing more than one band region of reduced film thickness and reduced diameter.
Figure 6:
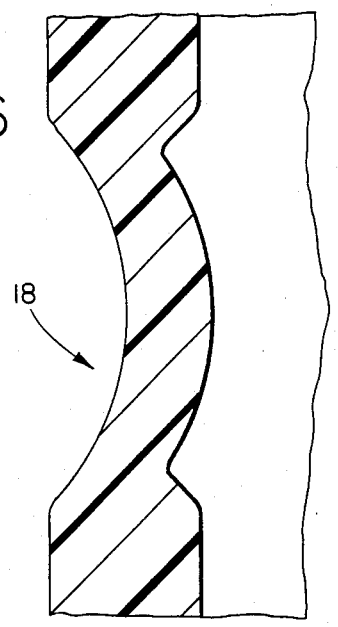
FIG. 6 is a cross section of an enlarged segment taken along lines 6—6 of FIG. 5 of part of the bag film revealing its reduction in thickness.

In FIG. 5, the thermoplastic sack 20 is shown having two bands 18 of reduced film thickness and reduced diameter. FIG. 6 shows, in enlarged, exaggerated form, the film reduction in thickness due to cold stretching in the area of one of the bands 18.

The bags can be made of any thermoplastic material capable of being cold stretched.

Although the present invention has been described with preferred embodiments, it is to be understood that modifications and variations may be resorted to, without departing from the spirit and scope of this invention as those skilled in the art will readily understand. Such modifications and variations are considered to be within the purview and scope of the appended claims.

What is claimed is:

1. A sack of a thermoplastic film comprising an open mouth region, a body region and a closed bottom region, said body region having at least one cold-strected, circumferential band region of reduced film thickness and of reduced diameter therein, said reduced film thickness and diameter being in relation to the film thickness and diameter of said body region.

2. The sack of claim 1 wherein said band region of reduced diameter is postioned in relation to said open mouth portion so as to accommodate a more secure, gripping overfold region when said sack is employed as a waste container liner.

3. The sack of claim 1 wherein there is a single band region.

4. The sack of claim 1 wherein there are a plurality of said band regions.

5. The sack of claim 1 wherein said thermoplastic film is of a polyethylene.

6. The sack of claim 1 wherein said film is from about 0.1–4 mils in thickness.

7. The sack of claim 1 wherein said closed bottom is closed by a heat-seal line bonding two or more layers of film together.

* * * * *